United States Patent [19]

Cachat

[11] 3,935,416

[45] Jan. 27, 1976

[54] INDUCTOR-WORKPIECE POSITION DETECTOR

[75] Inventor: John F. Cachat, Cleveland, Ohio

[73] Assignee: Park-Ohio Industries, Inc., Cleveland, Ohio

[22] Filed: June 24, 1974

[21] Appl. No.: 482,271

[52] U.S. Cl. ..... 219/10.77; 219/10.57; 266/5 EI

[51] Int. Cl.[2] ..... H05B 5/02

[58] Field of Search ..... 219/10.57, 10.75, 10.77; 266/5 EI, 4 EI; 200/47, 61.41, 61.42

[56] References Cited

UNITED STATES PATENTS

| | | | |
|---|---|---|---|
| 3,441,701 | 4/1969 | Seulen et al. | 219/10.57 X |
| 3,487,182 | 12/1969 | Grundy | 200/61.42 |
| 3,622,138 | 11/1971 | Kostyal | 266/4 EI X |
| 3,716,690 | 2/1973 | Bryant | 219/10.77 |
| 3,757,072 | 9/1973 | Del Paggio | 219/10.77 |
| 3,810,608 | 5/1974 | Vickers | 266/4 EI |

*Primary Examiner*—J. V. Truhe
*Assistant Examiner*—Clifford C. Shaw
*Attorney, Agent, or Firm*—Meyer, Tilberry & Body

[57] ABSTRACT

A desirable relative positional relationship between an inductor and a workpiece to be heated is detected by an electrical circuit which is closed upon relative movement of the inductor and workpiece to the desired relative position. The detecting circuit includes a contact positioned relative to the inductor and engagable with the workpiece upon relative movement of the inductor and workpiece in one direction. Upon such engagement a circuit is completed to stop relative movement in the one direction.

16 Claims, 3 Drawing Figures

FIG. 2
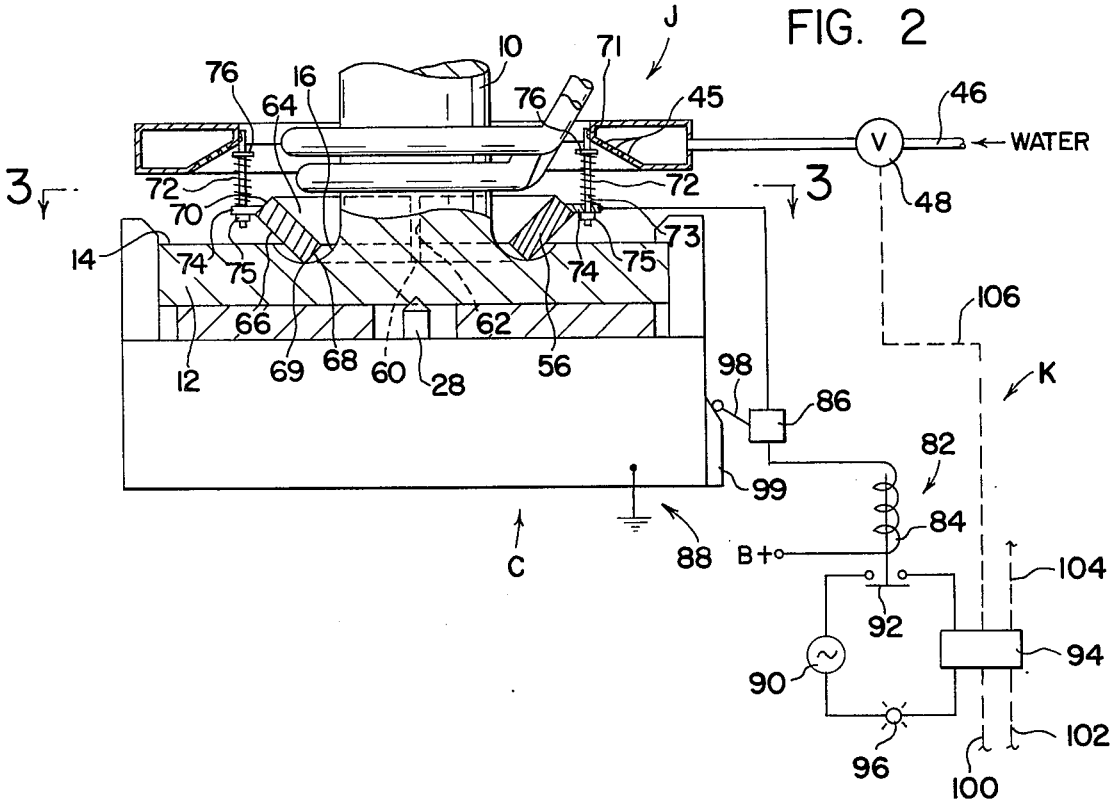
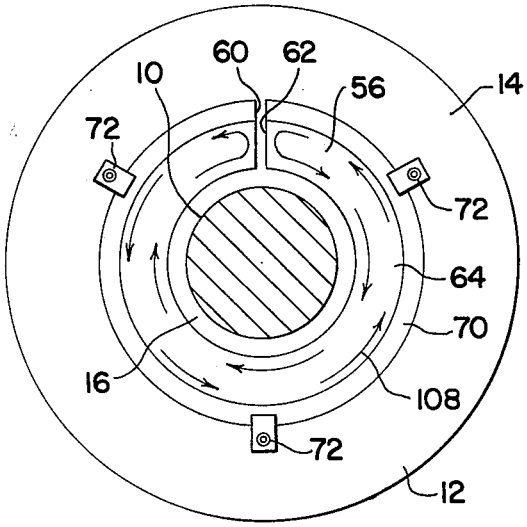
FIG. 3

INDUCTOR-WORKPIECE POSITION DETECTOR

This application relates to the art of induction heating and, more particularly, to induction heating and quench hardening of metal members.

The present invention is particularly applicable to the induction heating and quench hardening of shafts or shaftlike members, such as axle shafts, and will be discussed in detail with regard thereto. However, it will be appreciated that the invention has broader applications and may be used for inductively heating other metal members.

It is well known to inductively heat and harden a workpiece such as an axle shaft by supporting the workpiece at its opposite ends and displacing the workpiece relative to an inductor to progressively heat the workpiece from one end thereof towards the other. In apparatus of the type to which the present invention is directed, the workpiece and inductor are supported for relative scanning displacement and, prior to energization of the inductor, the workpiece and inductor are relatively displaced along a linear path to a predetermined relative position in which induction heating is to be initiated. The inductor and workpiece are relatively displaced in one direction toward the predetermined position by a suitable drive motor, and when the position is reached the drive motor is de-energized. Generally, the motor is reversible and manual or automatic controls are provided to reverse the motor so that the inductor and workpiece are relatively displaced in the opposite direction. Simulataneously, the inductor is energized and the workpiece is progressively heated during the ensuing relative movement therebetween. The workpiece is rotated about its axis during the relative scanning displacement, and quenching liquid is sprayed onto the heated workpiece behind the inductor with respect to the direction of scanning movement.

Often, the axle rod or other workpiece has an outwardly extending flange at the end thereof at which induction heating is to be initiated. The flange has a surface facing the shaft portion, and a fillet area joins the flange surface and the shaft portion. In order to inductively heat and quench harden the fillet area and flange, it is necessary to induce current in the flange as well as the shaft portion. In order to make the induced current in the flange of an optimum value, it is necessary that the flange be accurately positioned closely adjacent to the inductor when induction heating is initiated.

Various systems and devices such as fixed stops, limit switches and pneumatic position detecting arrangements have been employed heretofore in an effort to achieve desired relative positioning between the workpiece and inductor in this respect. Such prior systems and devices have not performed satisfactorily in use and/or have not been capable of prolonged use under the extremely high temperatures to which they are exposed. In this respect, for example, limit switches and fixed stops are necessarily pre-positioned and are not capable during operation of the apparatus of compensating for either an error in the positioning thereof or variances from design parameters in the workpiece. With regard to the latter, the upper surface of the flange of the workpiece or the fillet area, often has a high point in the direction of the axle shaft. With a pre-positioned limit switch or fixed stop arrangement, the optimum position of the inductor to the flange cannot be obtained and often, the inductor actually contacts the high point and this, of course, is extremely undesirable. The same undesirable effects can and do also occur as a result of errors in initially positioning the stops and switches, or deviations from the initial positions resulting from repeated use.

Still further, prior systems such as the pneumatic position detector disclosed in U.S. Pat. No. 3,757,072 issued Sept. 4, 1973 are operable only to sense the spacing between the inductor and workpiece flange along a linear path intersecting the workpiece flange at a given point. Thus, if a high point on the flange is not in the path of air flow, the end result is the same regarding undesirable positioning and possible inductor contact with the workpiece. Accordingly, such prior art devices do not enable obtaining and/or maintaining an optimum positional relationship between inductor and workpiece. The end result is non-uniformity between treated workpieces, loss or workpieces, and loss of production rate resulting from down time required to maintain or replace components of the apparatus.

It accordingly becomes desirable not only to achieve accuracy with respect to a predetermined positional relationship between the inductor and workpiece prior to initiating the induction heating operation but also to assure repeated accurate positioning even if variations from design parameters exist in the workpiece. Moreover, it is desirable to provide for such positioning to be achieved in a manner which maximized the capability of detecting a high spot on the workpiece flange regardless of the location thereof circumferentially with respect to the workpiece axis. These advantages are achieved in accordance with the present invention. More particularly, in accordance with a preferred embodiment, a position detector arrangement is provided which includes an electrical contact positioned relative to the inductor for direct engagement with the workpiece flange upon relative displacement of the workpiece to the desired position relative to the inductor. Upon engagement of the contact with the workpiece a circuit is completed to stop the drive motor by which the workpiece support and inductor are relatively displaced. Thereafter, the drive motor is reversed and the inductor energized to achieve workpiece heating during relative displacement in the opposite direction.

By providing a contact arrangement of the foregoing character the motor control is directly responsive to engagement of the contact with the workpiece, and the contact can be accurately positioned relative to the inductor to assure de-energization of the motor to achieve precise inductor-workpiece positioning. Moreover, in the preferred arrangment the contact circumferentially engages the workpiece flange, thus to increase the capability of achieving proper inductor-workpiece positioning regardless of the specific location of a high spot circumferentially of the flange. In this respect, the preferred contact is a copper ring coaxial with and closely adjacent one end of an inductor coil and adapted to extend around the workpiece stem. The ring is circumferentially interrupted to prevent undesirable heating thereof by induced current therein, and the ring is positioned to engage the flange of the workpiece in or adjacent the fillet area between the stem and flange. Preferably, the contact ring is mounted on a quench ring coaxial with the inductor coil. The contact is axially displaceable relative to the quench ring and inductor upon engagement with the workpiece, preferably through a spring arrangement by which the contact ring is mounted on the quench ring.

It is an outstanding object of the present invention to provide an improved device for inductively heating workpieces.

Another object of the present invention is to provide apparatus of the foregoing character with an improved arrangement for sensing the positional relationship between relatively displaceable workpieces and inductor components.

A further object is the provision of improved apparatus for inductively heating a radially flanged workpiece and which includes a position sensing or detecting electrical contact arrangement which is effective circumferentially with respect to the flange and workpiece axis.

Yet another object is the provision of apparatus of the foregoing character including a control circuit which closes upon engagement of an electrical contact with the workpiece to stop a drive motor by which the inductor and workpiece are relatively displayed into position for induction heating.

The foregoing objects, and others, will in part be obvious and in part pointed out more fully hereinafter in conjunction with the description of a preferred embodiment of the invention illustrated in the accompanying drawings in which:

FIG. 2 is an enlarged detail elevation view of a portion of the apparatus illustrated in FIG. 1 and showing the inductor and control circuit contact in the positions thereof when the contact engages the workpiece; and, FIG. 3 is a plan view of the contact ring looking in the direction of line 3—3 in FIG. 2.

Figure 1:
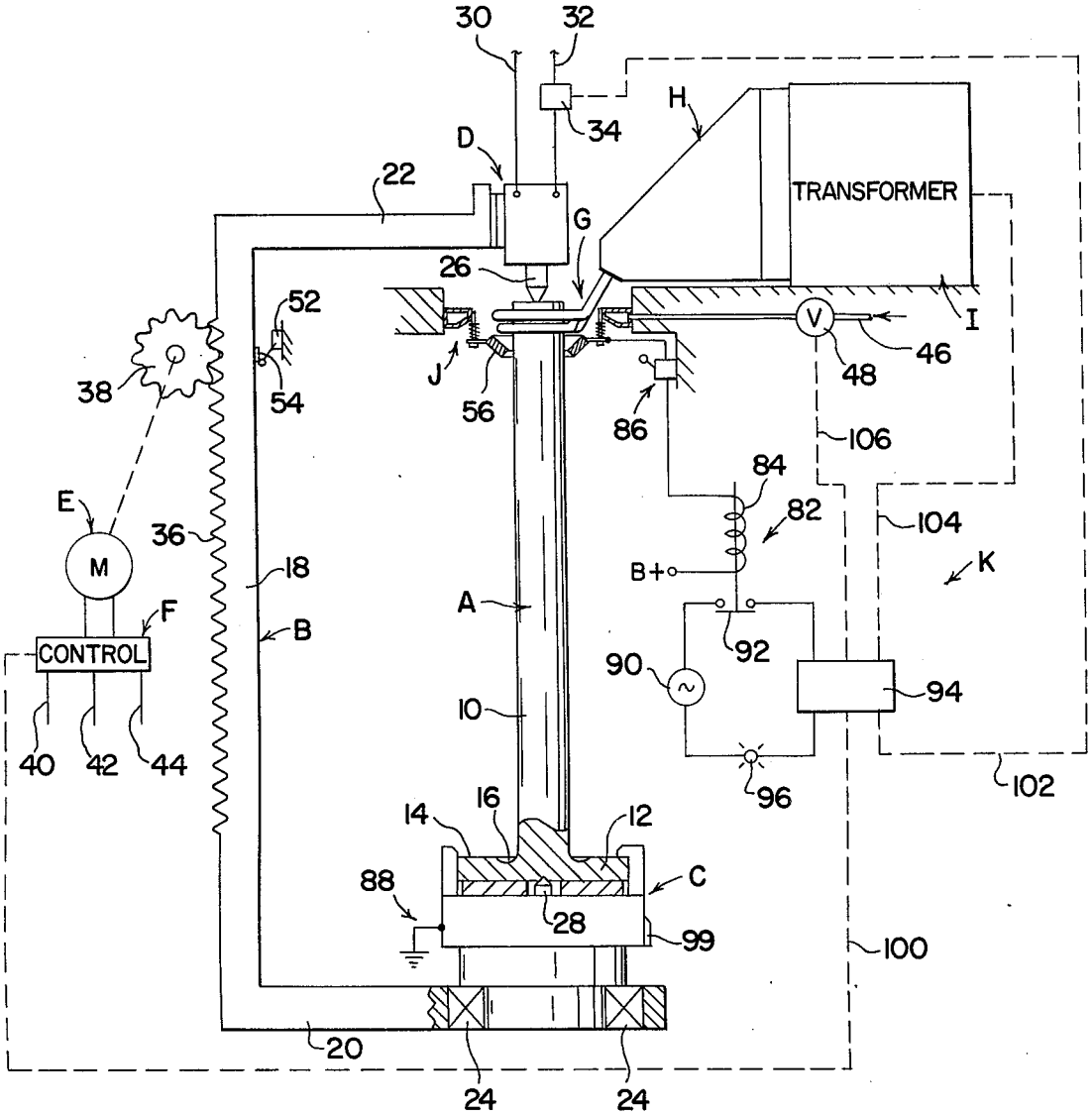
FIG. 1 is an elevation view induction heating apparatus having the position detecting arrangement of the present invention incorporated therein.

Referring now in greater detail to the drawings wherein the showings are for the purpose of illustrating a preferred embodiment of the invention only and not for the purpose of limiting the invention, FIG. 1 shows apparatus for inductively heating a workpiece A. In the embodiment shown, workpiece A is an axle shaft including an elongated generally cylindrical shaft portion 10 having a radially outward extending circular flange 12 at one end thereof. Flange 12 has a surface 14 facing shaft portion 10 and joined therewith by an axially concave fillet area 16. Flange 12 extends generally perpendicular to the longitudinal axis of shaft portion 10, and surface 14, fillet 16 and the outer surface of shaft portion 10 define the workpiece surfaces to be inductively heated and hardened.

Workpiece A is supported by a C-shaped support member B having a vertical leg 18, a horizontal leg 20 at the lower end of leg 18, and a horizontal leg 22 at the upper end of leg 18. Leg 20 supports a chuck C for rotation relative to support member B and, in this respect, the lower end of the chuck is mounted in a bearing 24 on leg 20. A motor D is mounted on the outer end of upper leg 22 and is provided with a driven centering spindle 26 engaging the corresponding end of workpiece A. Chuck C is provided with a centering spindle 28 engaging the corresponding end of workpiece A. Motor D preferably is an electric motor and is adapted to be energized from a suitable power source, not shown, through a pair of leads 30 and 32 and a relay switch 34, or other suitable control device, in one of the leads. It will be appreciated that energization of motor D causes workpiece A to rotate about its axis relative to support member B.

Vertical leg 18 of support member B is in the form of a rack provided with teeth 36, and support member B and thus workpiece A are adapted to be vertically reciprocated by means of a pinion 38 driven by a reversible electric motor E. Motor E is connected to a three-phase power supply, not shown, through leads 40, 42 and 44 and a motor control device F which is operable to selectively energize motor E for rotation of pinion 38 in opposite directions. Any suitable motor control device can be used for this purpose, such devices being well known and not forming a part of the present invention.

An inductor G is provided for inductively heating workpiece A. Inductor G may take many different forms and in the embodiment illustrated is a two turn tubular coil having an open center through which shaft portion 10 or workpiece A may extend. Inductor G is supported by mounting members H attached to a transformer I which is electrically connected to inductor G in a well known manner. Transformer I and thus inductor G are rigidly supported in a fixed position relative to workpiece support member B. As is well known, inductor G is comprised of tubular conductor material such as copper, and the opposite ends of the inductor are connected to a suitable source of cooling water, not shown, which is circulated through the inductor coil for cooling purposes.

In this embodiment shown, an annular tubular quenching conduit J surrounds workpiece A in coaxial relationship therewith. The quenching conduit surrounds inductor G so that the plane of the lower end of the conduit is slightly above the plane of the lower turn of the coil. It will be appreciated, however, that this positional relationship is not absolutely necessary. Quench conduit J is suitable supported in fixed relationship with respect to the inductor coil and includes a lower wall 45 which is apertured to direct cooling water downwardly and radially inwardly against workpiece A and beneath coil G. Conduit J is connected to a suitable source of water, not shown, by means of a water line 46 and a suitable solenoid operated flow control valve or the like 48.

In use of the apparatus as thus far described, workpiece support member B is moved to the position illustrated in FIG. 1 and a workpiece A is mounted on the support member as shown. Motor E is then energized through a suitable start switch or the like to displace support member B and workpiece A upwardly relative to inductor G and quench ring J to position flange 12 of the workpiece adjacent the inductor. As described more fully hereinafter, when the workpiece support member reaches a desired elevation relative to the inductor corresponding to the position of the components in which induction heating is to be initiated, motor E is stopped. Thereafter the motor is reversed through suitable controls to displace support member B and workpiece A downwardly. Simultaneously, inductor G and motor D are energized and induction heating proceeds. Upon sufficient displacement of flange 12 from inductor G, quenching liquid flows into the quench ring and is sprayed onto the heated workpiece to quench harden the workpiece.

In the embodiment shown, a limit switch 52 is supported adjacent leg 18 of support member B in a position to be engaged by a stop member 54 on leg 18 when the support member reaches the position illustrated in FIG. 1 designating the end of the induction heating and hardening operation. Switch 52 is operable through suitable control circuitry, not shown, to deenergize motors D and E, inductor G and quench ring control valve 48, and the quench hardened workpiece is then removed from the support member and another workpiece is mounted thereon for treatment in the foregoing member.

In accordance with the present invention, a unique arrangement is provided for the purpose of stopping workpiece support drive motor E when the flange of the workpiece reaches a predetermined position relative to the inductor at which induction heating is to be initiated. In the preferred embodiment, as best seen in FIGS. 2 and 3 of the drawing, the desired control is achieved by means of an electrically conductive contact member 56 and an electrical control circuit K which includes contact 56. Contact 56 is a ring of conductive material, preferably copper, having its opposite ends 60 and 62 circumferentially spaced apart for the purpose set forth hereinafter. Contact 56 closely surrounds shaft portion 10 of workpiece A in coaxial relationship therewith and is in the form of a flat plate of dished or conical configuration with respect to the axis of the opening therethrough. Preferably, the contact plate is of rectangular cross section, and the dished configuration provides for the wider dimensions of the plate to define top and bottom surfaces 64 and 66, respectively, and for the narrower dimensions to define radially inner and outer surfaces 68 and 70, respectively. The diameter of the opening through ring 56 and the dished configuration preferably provide for edge 69 between surface 66 and 68 to engage the lowermost point of concave fillet area 16, as shown in FIG. 2, thus to position inductor G as close as possible to flange 12.

Contact ring 56 is supported relative to inductor G and in a position to engage fillet area 16 of the workpiece when the workpiece support member is displaced in the direction to move flange 12 toward the inductor. In the embodiment disclosed, contact ring 56 is disposed beneath inductor G and quench ring J is mounted on inner sidewall 71 of the quench ring by means of a plurality of springs 72 and corresponding rods 73 having upper ends connected to sidewall 71 such as by welding. The lower ends of the rods extend through openings in mounting flanges 74 on contact ring 56 and are threaded to receive nuts 75. Washers 76 are attached to rods 73, and springs 72 are disposed between flanges 74 and washers 76 to bias the contact plate axially downwardly with respect to quench ring J and thus with respect to inductor G. Thus, the contact ring is displaced axially upwardly relative to the inductor upon engagement of ring edge 69 with the workpiece. This enables relative movement between the inductor and contact ring and between the inductor and workpiece following de-energization of motor E, thus to provide for such movement caused by coasting of the motor to a complete stop. Ring 56 is spaced from inductor G a distance sufficient for such coasting movement to take place without contact between ring 56 and the inductor, and the threaded rod and nut arrangement provides for this distance to be adjustable. Springs 72, rods 73, flanges 74, nuts 75 and washers 76 are of suitable non-magnetic material such as bronze.

As mentioned above, movement of workpiece support member B upwardly, as viewed in FIG. 1, results in engagement of contact ring edge 69 with the upper surface of fillet area 16 of workpiece flange 12. The annularity of edge 69 assures contact with the highest point of area 16 therebeneath should the fillet area be of non-uniform contour. Such engagement of the ring and workpiece denotes the predetermined relative location between the inductor and workpiece at which the induction heating and hardening operation is to be initiated, and electrical control circuit K functions upon engagement of contact ring 56 with the workpiece to at least de-energize workpiece support drive motor E and stop upward displacememt of the workpiece relative to inductor G. For purposes of illustration, control circuit K in the embodiment shown is operable to achieve certain control functions in addition to stopping motor E. In this respect, circuit K includes a first series circuit including a source of low voltage direct current designated B+, a relay switch 82 having a coil 84, a normally open switch 86, ring contact 56 described above, and a ground connection 88 to chuck C. Control circuit K further includes a second series circuit including a source of low voltage alternating current 90, switch contact 92 of relay switch 82, and a control device 94 producing an output signal or signals when energized by power source 90. If desired, an indicator light 96 can be included in the second series circuit to indicate circuit energization.

Switch 86 in the first series circuit is a normally open switch suitably supported in a fixed position relative to workpiece support member B and which serves the function set forth hereinafter. Switch 86 includes a suitable actuator 98 adapted to be engaged by a stop member 99 on chuck C prior to engagement of contact ring 56 with the workpiece so as to close the circuit between the contact ring and relay coil 84. Accordingly, when contact ring 56 engages fillet area 16 of flange 12, as illustrated in FIG. 2, a circuit is completed from the B+ source through coil 84, switch 86, contact 56 and chuck C to ground 88, whereby relay coil 84 is energized. Relay switch 82 is normally open, and energization of coil 84 closes the switch, whereby a circuit is completed through power source 90, switch contact 92, indicator light 96 and control device 94. Upon such energization, control device 94 produces an output signal or signals to control desired functions of the apparatus. Most importantly, as schematically illustrated in FIG. 1, control device 94 transmits a control signal through line 100 to motor control F, which signal actuates motor control F to de-energize electric motor E. After a brief pause, control F operates or is operated to reverse motor E.

In the embodiment shown, control device 94 also transmits a control signal through line 102 to motor control device 34 which controls energization of motor D, transmits a control signal through line 104 to achieve energization of inductor G, and transmits a control signal through line 106 to flow control valve 48 which controls quenching liquid flow into quench ring J. It will be appreciated that the control functions following de-energization of motor E can be achieved other than through control device 94 and that in any event these control functions will be coordinated to provide for the controlled function to take place at the desired time with respect to energization of motor E to achieve movement of workpiece support B downwardly following engagement of contact 56 with the workpiece. In this respect, energization of inductor G and motor D are substantially simultaneous with energization of motor E in the reverse directon, and the flow of quench liquid is slightly delayed following movement of workpiece support B in the downward direction.

When workpiece support member B descends relative to inductor G, fillet area 16 of workpiece flange 12 moves out of engagement with contact 56. Further, switch actuator 98 disengages stop member 99, whereby switch 86 opens. Upon disengagement between contact 56 and fillet area 16 relay coil 84 is de-energized, switch 82 opens and the circuit through control device 94 opens. The openings of switch 86 advantageously prevents any induced current from flowing into the first series circuit portion of the control circuit following displacement of the workpiece flange from contact ring 56.

The circumferentially open structure of contact ring 56 advantageously avoids induction heating and consequent burn-out of the contact ring by the inductor. In this respect, inductor G will induce current flow in ring contact 56 along a path as indicated by arrows 108. Since ring 56 is circumferentially interrupted, the induced current flows in circumferentially opposite directions with respect to the contact ring and has a cancelling effect which minimizes heating of the contact ring. Moreover, cooling of the contact ring can be achieved through quench ring J to further avoid undesirable heating thereof.

While considerable emphasis has been placed herein on a specific structural embodiment of the present invention, it will be appreciated that many embodiments as well as modifications of the embodiment disclosed can be made without departing from the principles of the present invention. In this respect, for example, workpiece support structures other than the structure illustrated and described can readily be employed as can a wide variety of inductor configurations and quenching liquid devices. Still further, it will be appreciated that the present invention can readily be employed in connection with the induction heating of a workpiece without liquid quenching, whereby the quench ring is not a necessary component of the structure. Further in this respect, it will be appreciated that many arrangements can be devised for supporting the contact ring relative to the inductor and for the desired relative displacement of the contact relative to the inductor upon engagement thereof with the workpiece. While the prefered embodiment provides for the workpiece support and thus the workpiece to be displaced relative to a fixed position inductor, it will be appreciated that arrangements can be devised for supporting the inductor for displacement relative to a longitudinally fixed workpiece support. It will be appreciated too that the contact ring can engage the workpiece flange other than in the fillet area, and that the inductor and workpiece positioning function can be employed in conjunction with a workpiece which does not have a radial flange engaged by the contact. In the latter respect, for example, a component of the workpiece support member could be positioned to be engaged by the contact ring to close the electrical control circuit. Still further, it will be appreciated that many circuit arrangements can be devised for achieving a desired control of the apparatus upon engagement of the contact with the workpiece or support and that, in the circuit disclosed, an alterating current power supply could replace the direct current supply shown and described.

Many embodiments, and modifications of the preferred embodiment disclosed, will be obvious to those skilled in the art upon reading and understanding the foregoing description of the preferred embodiment and, accordingly, it is to be distinctly understood that the descriptive matter herein is to be interpreted merely as illustrative of the present invention and not as a limitation.

What is claimed is:

1. An induction heating device comprising support means for an elongated metal workpiece including a stem having an axis and a radial flange at one end of the stem, an inductor coil for axially heating a workpiece supported by said support means, said coil being coaxial with said stem, electrical drive means for relatively displacing said workpiece support means and induction coil along a linear path parallel to said axis and in the direction to move said coil and flange toward one another, and electrical circuit means including energizable means for delivering a control signal to said drive means upon movement of said workpiece flange and inductor coil to a predetermined axially spaced position in said direction, said circuit means including an electrical contact ring positioned axially between said inductor coil and workpiece support means, said contact ring being supported relative to said inductor coil and in surrounding coaxial and radially spaced relationship with the stem of a workpiece on said support means, a power supply, and means connecting said contact ring and said workpiece support means in series across said power supply, said contact ring engaging said workpiece flange upon movement of said flange and inductor coil into said predetermined position, thus to close said circuit means and energize said means for delivering a control signal.

2. The device according to claim 1, and means supporting said electrical contact ring for axial displacement toward and away from said inductor coil.

3. The device according to claim 2, wherein said contact ring supporting means includes means biasing said contact ring in the direction away from said inductor coil.

4. The device according to claim 1, wherein said electrical contact ring is a circular element having circumferentially spaced apart ends.

5. The device according to claim 1, and quenching means fixed relative to said inductor coil for delivering quenching liquid toward said workpiece.

6. The device according to claim 5, wherein said electrical contact ring is mounted on said quenching means for displacement toward and away therefrom, and means biasing said contact ring away from said quenching means.

7. The device according to claim 6, wherein said quenching means is an annular member coaxial with said workpiece stem, and said contact ring is a circular element having circumferentially spaced apart ends.

8. The device according to claim 1, wherein said contact ring is a circular plate having circumferentially spaced apart ends, said plate inclining axially to provide a circumferentially extending contact edge line facing in the direction of said workpiece flange.

9. An induction heating device including an inductor means for heating a workpiece having a stem and a radial flange on one end of said stem, said inductor means being a coil coaxial with said stem, workpiece support means, means supporting said workpiece support means for axial displacement relative to said coil to move the flange of a workpiece supported thereby toward and away from said coil, electrical drive motor means for displacing said workpiece support means, and electrical control circuit means for said motor means and operable to deenergize said motor means when said workpiece flange and inductor coil move into a predetermined axially spaced position, said control circuit means including a relay control circuit comprising a source of direct current, an electrical contact ring axially between said coil and the flange of a workpiece on said support means, said contact ring being supported relative to said inductor coil and in surrounding relationship with respect to the stem of a workpiece on said workpiece support means, a relay coil connected in series between one side of said source and said contact ring, and means grounding said workpiece support means, said contact ring engaging said workpiece flange to establish an electrical coupling with said workpiece support means upon movement of said workpiece flange and coil into said axially spaced position, whereby said relay coil is energized, said control circuit means further including means actuated in response to energization of said relay coil to de-energize said motor means.

10. The device according to claim 9, including normally open switch means in said relay circuit between said contact ring and relay coil, and means actuable in response to movement of said workpiece support means for closing said normally open switch means when said workpiece and inductor means reach said predetermined position.

11. The device according to claim 9, and means including spring means supporting said contact ring for displacement between first and second axial positions relative to said inductor coil.

12. The device according to claim 11, wherein said contact is an annular element having circumferentially spaced apart ends.

13. The device according to claim 12, and normally open switch means in electrical series between said contact ring and relay coil, and said normally open switch means being in a fixed position with respect to said inductor coil and having displaceable actuating means, and means on said workpiece support means to displace said actuating means to close said normally open switch upon movement of said workpiece and inductor coil into said relative position.

14. The device according to claim 12, and means surrounding said workpiece and coaxial with said inductor coil and contact ring for directing quenching liquid toward said workpiece.

15. The device according to claim 12, wherein said means supporting said contact ring includes quenching liquid conduit means surounding said workpiece and coaxial with said inductor coil and contact ring for directing quenching liquid toward said workpiece.

16. The device according to claim 9, wherein said contact ring is a circular plate having circumferentially spaced apart ends, said plate inclining axially to provide a circumferentially extending contact edge line facing in the direction of said workpiece flange.

* * * * *